US005938867A

United States Patent [19]

Dorward et al.

[11] Patent Number: 5,938,867

[45] Date of Patent: Aug. 17, 1999

[54] METHOD OF MANUFACTURING ALUMINUM AIRCRAFT SHEET

[75] Inventors: Ralph C. Dorward, Livermore; Steven D. Kennedy, Danville, both of Calif.

[73] Assignee: Kaiser Aluminum & Chemical Corporation, Pleasanton, Calif.

[21] Appl. No.: 08/824,555

[22] Filed: Mar. 25, 1997

Related U.S. Application Data

[63] Continuation of application No. 08/597,540, Feb. 2, 1996, abandoned, which is a continuation-in-part of application No. 08/407,842, Mar. 21, 1995, abandoned.

[51] Int. Cl.[6] ..... C22C 21/12; C22F 1/04

[52] U.S. Cl. ..... 148/693; 148/700; 148/439; 420/533; 420/534; 420/535; 420/544

[58] Field of Search ..... 148/693, 700, 148/439; 420/533, 534, 535, 542, 543, 544, 546, 547, 553

[56] References Cited

U.S. PATENT DOCUMENTS

| | | | |
|---|---|---|---|
| 3,847,681 | 11/1974 | Waldman et al. | 148/693 |
| 4,294,625 | 10/1981 | Hyatt et al. | 148/439 |
| 4,336,075 | 6/1982 | Quist et al. | 148/439 |
| 5,213,639 | 5/1993 | Colvin et al. | 148/693 |
| 5,273,594 | 12/1993 | Cassada | 148/696 |

OTHER PUBLICATIONS

Thompson et al., "Special Processing of Al–Cu–Mg Alloys", Abstract 651872, MA No. 79–560035 (1979).

Sugamata et al., Effect of Thermomechanical Treatment on Mechanical Properties of 2024 Aluminum Alloy, Abstract 898068, MA No. 84–312849 (1983).

Alcoa Report, Effects of Microstructure on Fatigue Crack Growth in High–Strength Aluminum Alloys, Technical Report AFML–TR–76–169, Oct. 1976 pp. 1–255.

Erhardt et al., Technical Report AFML–TR–69–85 The Role of Structure, Low Strain Rates, High Strain and Temperature on the Low Cycle Fatigue Behavios Of 2024–T4 Aluminum Alloy, 1969, pp. 1–38.

McEvily, Jr. et al., Report "Effect of Thermal–Mechanical Processing on the Fatigue and Stress–Corrosion Properties of an Al/Zn–Mg Alloy", Transactions of the ASM, vol.60, 1967, pp. 661–671.

Reynolds Report AD–770–350 "Program to Improve the Facture Toughness and Fatigue Resistance of Aluminum Sheet and Plate for Aircraft Applications", Sep., 1973, pp. 1–105.

Staley, J. T., Alcoa Report Fracture Toughness and Microstructure of High Strength Aluminum Alloys, May 23, 1974.

Staley et al., "Improving Fatigue Resistance of Aluminum Aircraft Alloys", Communication from Alcoa Technical Center presented at Western Tool Expo and Metal Congress, Los Angeles, Mar. 1977, pp. 667–669.

(List continued on next page.)

*Primary Examiner*—George Wyszomierski
*Attorney, Agent, or Firm*—Philip L. McGarrigle; Gerald D. Haynes

[57] ABSTRACT

A method of producing an aluminum product comprising providing stock including an aluminum alloy comprising about 4.0 to 4.4 wt. % copper, about 1.25 to 1.5 wt. % magnesium, about 0.35 to 0.5 wt. % manganese, not more than 0.12 wt. % silicon, not more than 0.08 wt. % iron, not more than 0.06 wt. % titanium, the remainder substantially aluminum, incidental elements and impurities; hot working the stock; annealing at 725–875° F.; cold rolling; solution heat treating; cooling; holding for at least 12 hours at room temperature; and cold working from about 4% to 7% thereby producing a product having increased strength and toughness properties.

24 Claims, 10 Drawing Sheets

OTHER PUBLICATIONS

Thompson et al., "Thermomechanical Processing of Aluminum Alloys", The Metallurgical Society, Oct. 18, 1978, pp. 74–83.

Titchener et al., "The Effect of Thermomechanical Treatment on the Fatigue Behaviour of an Al–Mg–Si–Mn Alloy", Department of Chemical and Materails Engineering, University of Auckland, Aug. 1973, pp. 432–436.

Waldman et al., "The Effect of Ingot Processing Treatments on the Grain Size and Properties of Al Alloy 7075", Metallurgical Transactions, vol. 5, Mar. 1974.

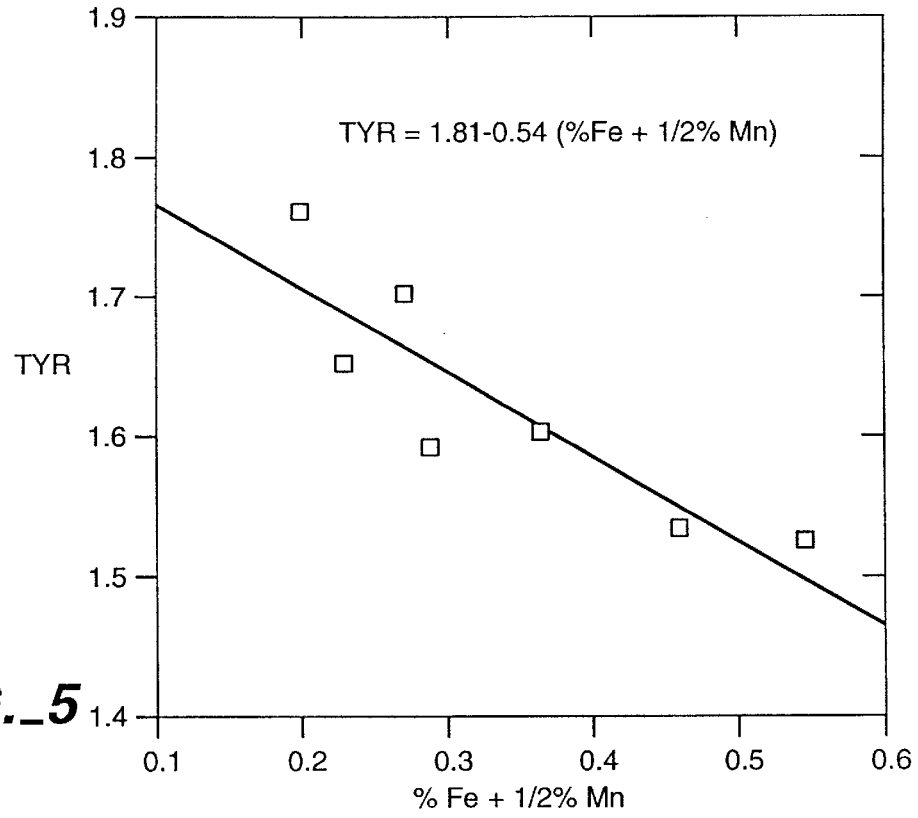
FIG._5
FIG._6
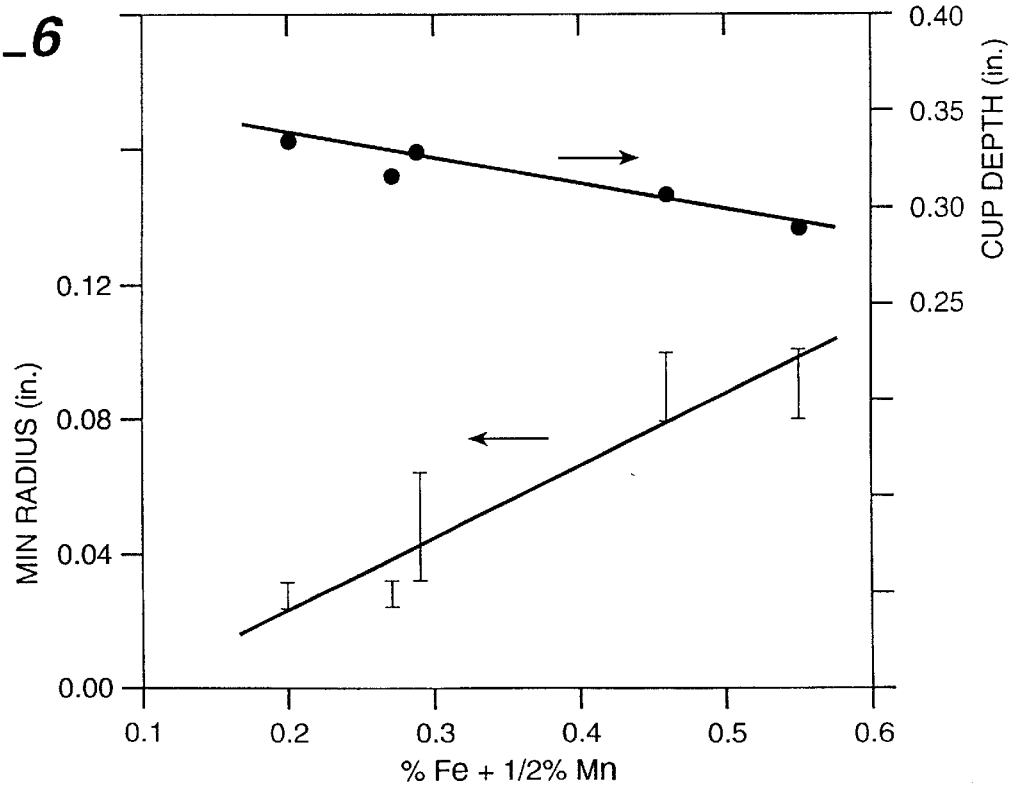

METHOD OF MANUFACTURING ALUMINUM AIRCRAFT SHEET

This application is a continuation of application Ser. No. 08/597,540, filed Feb. 2, 1996 now abandoned, which is a continuation in part of application Ser. No. 08/407,842, filed Mar. 21, 1995, now abandoned.

BACKGROUND OF THE INVENTION

1. Field of Invention

This invention relates to aluminum alloys suitable for use in aircraft applications. More specifically, it relates to a method of making an improved aluminum product having improved damage tolerant characteristics, including improved fracture toughness, fatigue resistance, corrosion resistance, formability and surface roughness properties.

2. Description of the Related Art

The design of commercial aircraft requires different sets of properties for different types of structures. Depending on the design criteria for a particular airplane component, improvements in fracture toughness and fatigue resistance result in weight savings, which translate to fuel economy over the lifetime of the aircraft, and/or a greater level of safety. For example, a slower fatigue crack growth rate will require a longer time for a crack or flaw to grow to a size where it becomes "critical" leading to catastrophic failure; and higher fracture toughness means that a crack can grow to a longer length before it is critical.

Corrosion damage has been a perennial problem in today's aircraft, and the fuselage is the prime location for corrosion to occur. Improvements in corrosion resistance, therefore, are often sought with or without weight savings.

The issues of toughness, fatigue and corrosion all relate to structural integrity of the airplane. Also, the aerospace manufacturers have long established an interest in sheet products that exhibit improved formability as a means to reduce manufacturing costs. An improved formability sheet product is able to reduce the number of forming steps associated with the fabrication of a given part, in addition to avoiding the scrap associated with difficult-to-make parts.

For some time, heat treatable aluminum base alloy sheet and plate containing copper, magnesium and manganese has found considerable acceptance for various structural members. Such alloys generally contain 3.8 to 4.9 wt. % copper, 1.2 to 1.8 wt. % magnesium and 0.3 to 0.9 wt. % manganese and carries the Aluminum Association designation of 2024 alloy. This alloy is noted for its superior strength to weight ratio, its good toughness and tear resistance, and adequate resistance to general and stress corrosion effects.

Workers in the field have generally adapted the 2024 alloy for use in the construction of commercial aircraft. For example, one alloy used on the lower wing skins of some commercial jet aircraft is alloy 2024 in the T351 temper. Alloy 2024-T351 has a relatively high strength-to-density ratio and exhibits reasonably good fracture toughness, good fatigue properties, and adequate corrosion resistance. U.S. Pat. Nos. 4,336,075 to Quist et al. and 4,294,625 to Hyatt et al. disclose an alloy which has a higher strength to density ratio, improved fatigue and fracture toughness characteristics over alloy 2024 while maintaining corrosion resistance levels approximately equal to or slightly better than 2024. Quist et al. and Hyatt et al. achieve their improvements by homogenizing the alloy at a moderate temperature, carefully controlling the hot-rolling and extrusion parameters and then natural age-hardening to produce a highly elongated, substantially unrecrystallized microstructure. Similarly, U.S. Pat. No. 5,213,639 to Colvin et al. discloses an alloy which has at least a 5.0% improvement over 2024 alloy in T-L fracture toughness or fatigue crack growth rate by re-heating the alloy prior to hot rolling. Yet no one has been able to develop an alloy which combines all of the above mentioned properties as well as significantly improving the formability of the T3 condition to impact manufacturing costs and ease of manufacturing.

There still remains a need, therefore, for an improved alloy that has increased fracture toughness, fatigue resistance, corrosion resistance and formability over alloy 2024, particularly in the T3 condition. Accordingly, it is the primary object of this invention to provide such an alloy.

SUMMARY OF THE INVENTION

The present invention provides a product comprising an aluminum base alloy including about 3.8 to 4.5 wt. % copper, about 1.2 to 1.6 wt. % magnesium, about 0.3 to 0.6 wt. % manganese, not more than about 0.15 wt. % silicon, not more than about 0.12 wt. % iron, not more than about 0.1 wt. % titanium, the remainder substantially aluminum, incidental elements and impurities, the product having at least 5% improvement over 2024 alloy in fracture toughness, fatigue crack growth rate, corrosion resistance, and formability properties.

In an alternative embodiment, the invention provides a method of producing an aluminum product comprising providing stock including an aluminum alloy comprising about 3.8 to 4.9 wt. % copper, about 1.2 to 1.8 wt. % magnesium, about 0.3 to 0.9 wt. % manganese, not more than 0.30 wt. % silicon, not more than 0.30 wt. % iron, not more than 0.15 wt. % titanium, the remainder substantially aluminum, incidental elements and impurities; hot working the stock; annealing; cold rolling; solution heat treating; and cooling thereby producing an alloy having improved fracture toughness, fatigue resistance, corrosion resistance, and formability properties.

In another embodiment, the invention provides a method of producing an aluminum product having improved formability properties. The method includes providing stock comprising an aluminum alloy comprising about 3.8 to 4.9 wt. % copper, about 1.2 to 1.8 wt. % magnesium, about 0.3 to 0.9 wt. % manganese, not more than 0.30 wt. % silicon, not more than 0.30 wt. % iron, not more than 0.15 wt. % titanium, the remainder substantially aluminum, incidental elements and impurities; hot working the stock; annealing; solution heat treating; cooling; and minimal cold working to produce an improved alloy having increased formability.

In a further embodiment, we provide a method of producing an aluminum product having optimized strength and toughness properties. The method includes the above process except that after the cooling step, the product is held until the alloy obtains a stable condition. The product is then cold worked to attain increased strength properties with good toughness properties.

The foregoing and other objects, features, and advantages of the invention will become more readily apparent from the following detailed description of preferred embodiment which proceeds with reference to the drawings.

BRIEF DESCRIPTION OF THE DRAWINGS

FIG. 5 is a graph showing tear strength—yield strength ratio (TYR) as correlated with manganese and iron levels.

FIG. 6 is a graph showing formability parameters as a function of iron and manganese levels.

DETAILED DESCRIPTION OF THE INVENTION

Figure 1:
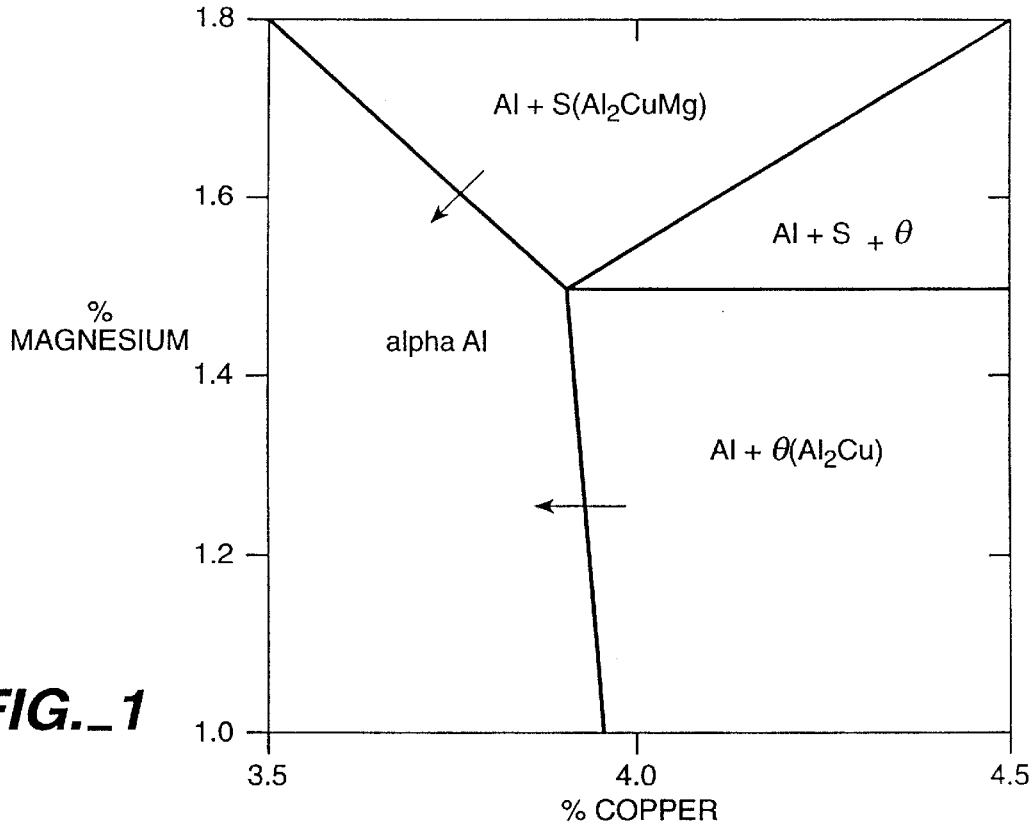
FIG. 1 shows composition-phase relations for an Al—Cu—Mg system at 930° F.

The fracture toughness, fatigue resistance, corrosion resistance, and formability properties of the present invention are dependent upon a chemical composition that is closely controlled within specific limits as set forth below and upon carefully controlled and sequenced process steps. If the composition limits or process parameters stray from the limits set forth below, the desired combination of fracture toughness, fatigue resistance, corrosion resistance, formability, and surface smoothness objectives will not be achieved.

The aluminum alloy of the present invention comprises about 3.8 to 4.5 wt. % copper, about 1.2 to 1.6 wt. % magnesium, about 0.3 to 0.6 wt. % manganese, not more than about 0.15 wt. % silicon, not more than about 0.12 wt. % iron, and not more than about 0.10 wt. % titanium, the balance being aluminum and impurity elements. For any remaining trace elements, each has a maximum limit 0.05 wt. %, with a total maximum of 0.15 wt. %. A preferred alloy would comprise about 4.0 to 4.4 wt. % copper, about 1.25 to 1.5 wt. % magnesium, about 0.35 to 0.50 wt. % manganese, not more than about 0.12 wt. % silicon, not more than about 0.08 wt. % iron, and not more than about 0.06 wt. % titanium, the balance being aluminum and impurity elements.

The chemical composition of the alloy of the present invention is similar to that of alloy 2024, but is distinctive in several important aspects. The alloying elements contained in the allowed range of variation for alloying elements contained in the invention alloy is less than for 2024. This is important because many mechanical and physical properties change as composition changes. To maintain the desired close balance of properties of the invention it is therefore necessary to restrict composition changes to a greater degree than is normally done. In addition, to the restricted ranges of copper, magnesium, and manganese, the silicon, iron, and titanium concentrations are reduced to the lowest levels commercially feasible for aluminum alloys of the present type in order to improve the fracture toughness.

Improved Fracture Toughness

The "damage tolerant" design philosophy being used today for commercial and military aircraft assumes that all structures contain flaws (cracks). The stress at the tip of a sharp crack is characterized by a stress intensity factor K, given by $$K=Y\sigma\sqrt{c}.$$

where $\sigma$ is the average applied stress on the structure (pounds per square inch), Y is a dimensionless parameter dependant on the geometry of the structural member, and c is the crack length. The stress intensity factor at which the crack begins to extend, generally resulting in catastrophic failure, is known as the fracture toughness of the material.

We now consider the factors that affect the fracture toughness of heat treated aluminum alloys, i.e., those alloys that derive their strength from thermal treatments such as a "solutionizing" operation that dissolves the alloying elements, followed by rapidly cooling to room temperature (quenching), and then "aging" at room temperature or higher (250 to 375° F.) to precipitate the alloying elements as small discrete particles within the aluminum matrix. Two major controls must be maintained on the chemical composition of these alloys. First, the iron impurity level must be kept to a minimum, because it is insoluble in aluminum and forms coarse, brittle intermetallic particles that contribute to crack extension and fracture. Second, the amounts of the major alloying elements, such as copper and magnesium, should be controlled to ensure that they are dissolved into the aluminum matrix during the solutionizing operation. Any intermetallic particles that are left undissolved reduce fracture toughness as do those resulting from high iron levels.

FIG. 1 graphically illustrates an equilibrium phase diagram for the aluminum (Al)-copper (Cu)-magnesium (Mg) system at 930° F. Specifically, FIG. 1 defines the copper and magnesium concentrations that can be dissolved. If the limits defined by the alpha aluminum region are exceeded, undissolved particles of $Al_2CuMg$ (commonly designated as "S" phase) and $Al_2Cu$ (commonly designated as "θ" phase), remain after solution heat treatment. This situation is complicated by the presence of iron, which can combine with copper to from an insoluble $Al_7Cu_2Fe$ intermetallic constituent. The copper level in FIG. 1 therefore must be adjusted upwards by an amount equal to approximately twice the iron concentration because the $Al_7Cu_2Fe$ constituent contains about two times as much copper as iron.

A third compositional factor is the role of sparingly soluble alloying elements such as chromium, manganese and zirconium. One or more of these alloying elements are intentionally added to aluminum to form "dispersoids," which are small intermetallic particles that are useful in controlling the crystallite, or "grain" structure of aluminum alloys. All metallic products are comprised of numerous crystallites, or grains, which should not be allowed to grow to a large size during any of the thermal processing operations, because strength and good fracture toughness are favored by small grains. The dispersoid particles act to "pin" the grains and prevent their growth.

The dispersoid forming element in Al—Cu—Mg alloy 2024 is manganese in the range of 0.3 to 0.9%. Unexpectedly, we have discovered a significant effect of manganese on fracture toughness as measured by two test methods. In one method, we tested to failure 16-inch wide by 36-inch long panels with a 4-inch long through-thickness sharp crack in the orientation transverse to the rolling direction (T-L). Using an equation similar to $K=Y\sigma\sqrt{c}$, above, we calculated values of K (apparent) or $K_{app}$. It is noteworthy that $K_{app}$ determined in this manner is only an indicator of the true fracture toughness, the stress required to cause failure exceeded the elastic limit of the material. A wider panel would be required to obtain the actual fracture toughness, and is the capability of most test laboratories. In the second method, a 1.5-inch wide by 2.25-inch long panel with a sharp notch on one side was pulled to failure and the tear strength (maximum load divided by the cross sectional area) was measured. The tear strength divided by the yield strength as determined in a standard tensile test, commonly called the tear-yield ratio (TYR), is known to correlate with fracture toughness. Table 1 illustrates a number of production lots of 2024 alloy sheets having various iron and manganese contents which we tested for toughness by the aforementioned methods. Table 2 illustrates the results of these tests.

TABLE I

CHEMICAL COMPOSITIONS OF PRODUCTION LOTS OF 2024-T3 SHEETS
(Core alloy with cladding removed)

| | % by wt[a] | | | | | | |
|---|---|---|---|---|---|---|---|
| Alloy | Si | Fe | Cu | Mn | Mg | Ti | Zn |
| 1 | <0.1 | 0.035 | 4.31 | 0.33 | 1.37 | 0.02 | 0.02 |
| 2 | <0.1 | 0.04 | 4.21 | 0.46 | 1.28 | 0.02 | 0.02 |
| 3 | <0.1 | 0.07 | 3.99 | 0.32 | 1.37 | 0.02 | 0.06 |
| 4 | <0.1 | 0.07 | 3.99 | 0.44 | 1.28 | 0.04 | 0.22 |
| 5 | <0.1 | 0.17 | 4.21 | 0.39 | 1.44 | 0.03 | 0.03 |
| 6 | <0.1 | 0.16 | 4.17 | 0.77 | 1.21 | 0.03 | 0.07 |
| 7 | <0.1 | 0.19 | 4.43 | 0.54 | 1.48 | 0.01 | 0.01 |

[a]By inductively coupled plasma spectroscopy.

TABLE 2

EFFECT OF IRON AND MANGANESE CONTENTS ON TOUGHNESS OF ALCLAD 2024-T3 SHEET[a]

| Alloy No. | % Fe | % Mn | T-L $K_{app}$ (ksi √ in) | T-L TS/YS[b] | YS[c] (ksi) |
|---|---|---|---|---|---|
| 1 | 0.035 | 0.33 | 89 | 1.76 | 45.5 |
| 2 | 0.04 | 0.46 | 87 | 1.70 | 46.3 |
| 3 | 0.07 | 0.32 | 85 | 1.65 | 45.4 |
| 4 | 0.07 | 0.44 | 82 | 1.59 | 44.4 |
| 5 | 0.17 | 0.39 | 83.5 | 1.60 | 43.4 |

TABLE 2-continued

EFFECT OF IRON AND MANGANESE CONTENTS ON TOUGHNESS OF ALCLAD 2024-T3 SHEET[a]

| Alloy No. | % Fe | % Mn | T-L $K_{app}$ (ksi √ in) | T-L TS/YS[b] | YS[c] (ksi) |
|---|---|---|---|---|---|
| 6 | 0.16 | 0.77 | 77.5 | 1.52 | 44.5 |
| 7 | 0.19 | 0.54 | 79.5 | 1.53 | 44.2 |

[a]Also: 4.0–4.5% Cu and 1.2–1.5% Mg; all 0.063" thick.
[b]Tear strength - yield strength ratio (TYR).
[c]Transverse tensile yield strength.

Figure 2:
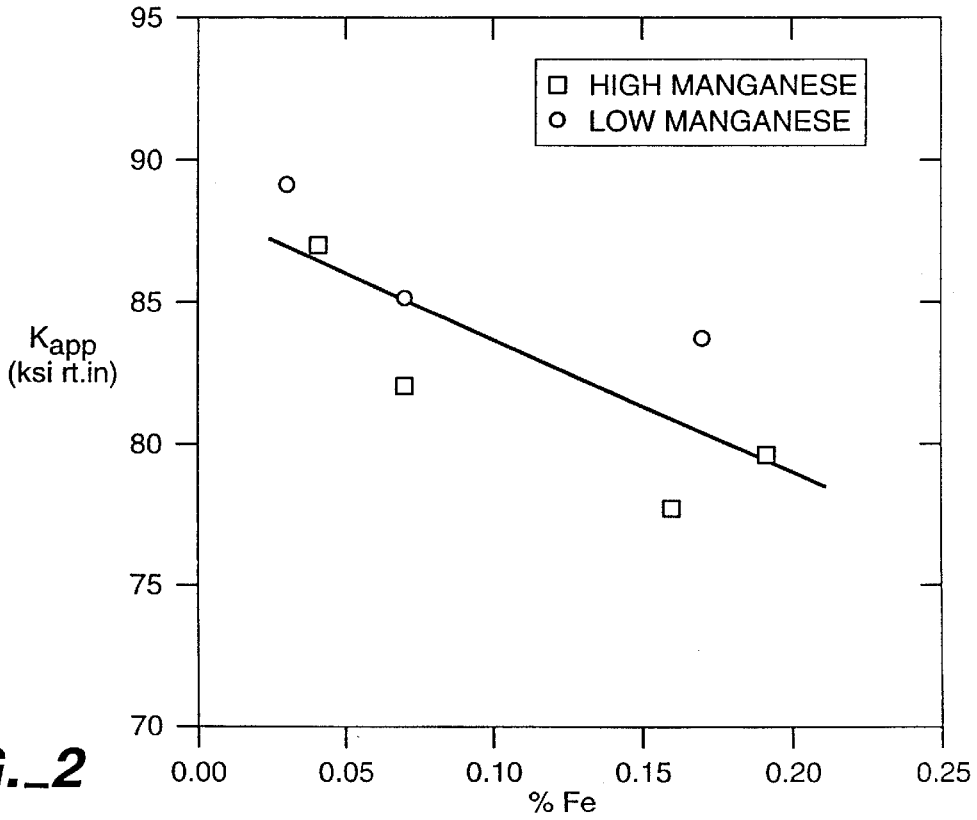
FIG. 2 is a graph showing fracture toughness ($K_{app}$)as a function of iron content.
Figure 3:
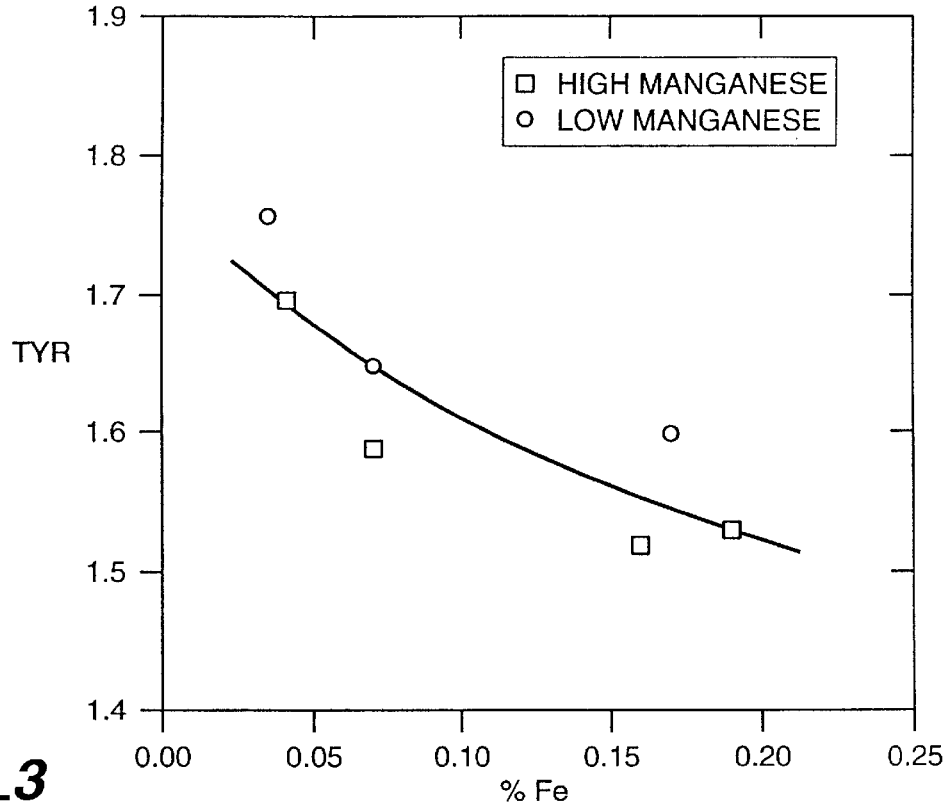
FIG. 3 is a graph showing tear strength—yield strength ratio (TYR) as a function of iron content.

We used data from Table 2 to plot the toughness measurements as a function of wt. % in FIGS. 2 and 3. As expected, FIGS. 2 and 3 demonstrate a correlation of fracture toughness with decreasing concentrations of iron. Surprisingly, however, the lots with relatively low manganese levels exhibit higher toughness values for a given iron content. Table 3, which compares the toughness levels at two manganese levels for a number of iron concentrations, also demonstrates this phenomenon. Table 3 also lists copper contents for each alloy, because high levels of copper can reduce toughness by the presence of undissolved $Al_2Cu$ and $Al_2CuMg$ phases. Notably, the copper levels of the alloys being compared in each case are almost equivalent.

TABLE 3

EFFECT OF MANGANESE AT VARIOUS IRON LEVELS ON TOUGHNESS OF ALCAD 2024-T3 SHEET

| ALLOY | % MN | % CU | T-L $K_{app}$ | T-L TS/YS[b] |
|---|---|---|---|---|
| | | 0.035–0.04% Fe | | |
| 1 | 0.33 | 4.31 | 89 | 1.76 |
| 2 | 0.46 | 4.21 | 87 | 1.70 |
| | Δ (%) | | 2.3 | 3.50 |
| | | 0.07% Fe | | |
| 3 | 0.32 | 3.99 | 85 | 1.65 |
| 4 | 0.44 | 3.99 | 82 | 1.59 |
| | Δ (%) | | 3.5 | 3.80 |
| | | 0.16–0.17% Fe | | |
| 5 | 0.39 | 4.17 | 83.5 | 1.6 |
| 6 | 0.77 | 4.21 | 77.5 | 1.52 |
| | Δ (%) | | 7.7 | 5.3 |
| | Ave. Δ/0.1% Mn | | 2.2 | 2.4 |

[a]Tear strength - yield strength ratio (TYR)

Figure 4:
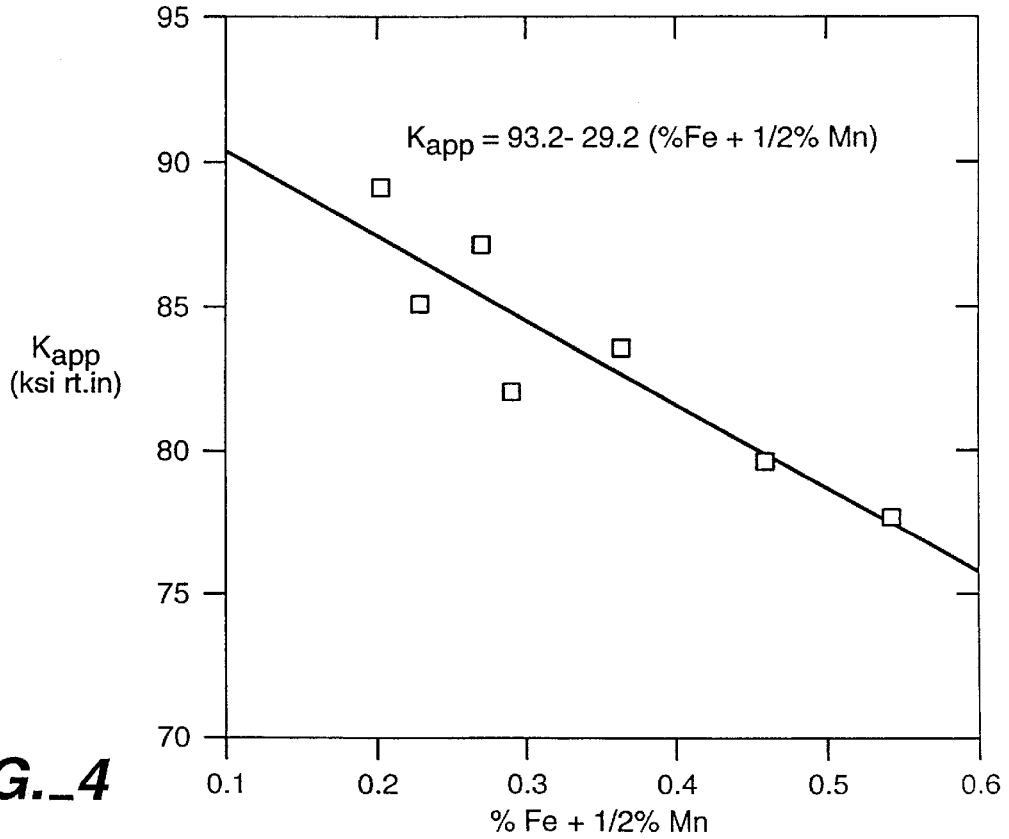
FIG. 4 is a graph showing fracture toughness ($K_{app}$) as correlated with manganese and iron levels.

A linear regression analysis of the $K_{app}$ data showed that manganese has approximately half the detrimental effect that iron has. This discovery is particularly important because of the relatively high levels of manganese in alloys such as 2024. Specifically, FIG. 4 demonstrates toughness, $K_{app}$, as a function of iron and manganese concentrations, producing the correlation:

$$K_{app}=93.2-29.2(\%\ Fe+0.50\%\ Mn)$$

Similarly, toughness, expressed as tear-yield ratio or TYR, is represented by the correlation:

$$TYR=1.81-0.54(\%\ Fe+0.50\%\ Mn)$$

This correlation is illustrated in FIG. 5.

Improved Fatigue Resistance

As noted in the previous section, the "damage tolerant" design philosophy assumes that flaws (cracks) are present in all structural materials. If these cracks are permitted to grow to a "critical" size such that the stress intensity factor at the crack tip exceeds the fracture toughness of the material, catastrophic failure occurs. Cracks can grow as a result of cyclic loads (fatigue) caused by takeoff and landing or cabin pressurization and depressurization. Fatigue crack growth rates for the projected cyclic loading stresses are therefore desirably low.

Experimentally, we found that the velocity of cracks growing under fatigue conditions, i.e., the fatigue crack growth rate, is dependent on the stress intensity factor difference (ΔK) associated with the minimum and maximum load. The stress intensity factor increment (ΔK) must therefore, be specified when comparing fatigue crack growth rates for different materials.

In addition to improved toughness, we also discovered that higher purity alloys with relatively low manganese levels also had low fatigue crack growth rates. We determined this by running tests at a stress intensity increment (ΔK) of 30 ksi√in. and a load ratio (maximum load divided by minimum load) of 0.1 on several of the alloys listed in Tables 1–3. For example, alloys 1 and 2 had average crack growth rates of 7.0×10-5 and 7.5×10-5 inches/cycle, compared to a nominal value of 20×10-5 inch/cycle for standard 2024 alloy typified by alloy 7. Thus, the alloy of our invention has about a 50% decrease in crack growth rate over standard 2024 alloy at a ΔK of 30 ksi√in. Similarly, we discovered fatigue benefits at lower values of ΔK. For example, at a ΔK of 5 ksi√in., alloys 1,2,3, and 4 had crack growth rates of 1.5 to 2.2×10-7 inches/cycle compared to 1.7 to 4.0×10-7 inches/cycle for standard 2024 alloy. Or stated another way, our new alloy had about a 25% decrease in crack growth rate in the low ΔK regime.

Improved Corrosion Resistance

Yet another benefit of the new alloy of my invention is improved corrosion resistance. As we noted earlier, good corrosion resistance is of prime concern in aircraft fuselage structures. Corrosion of aluminum alloys is usually aggravated by salt (sodium chloride) containing environments such as can be present near oceans. Sheet samples from alloys 3 and 7 (of Tables 1–3) were therefore exposed to a marine atmosphere at Daytona Beach, Fla. for one year. The protective cladding was removed from one surface so that the inherent corrosion resistance of the core alloy could be assessed. This also simulates the practical situation where one side of a fuselage panel is chemically milled to a thinner section size. After the one-year exposure period, tensile specimens were machined from the samples, and as recommended in the Corrosion Handbook (edited by H. H. Uhlig, John Wiley & Sons, p. 956), the corrosion damage was quantified by loss in ductility. This method is particularly suited to materials that are susceptible to pitting and intergranular corrosion. Table 4 summarizes tensile elongation measurements before and after the exposure to the marine atmosphere. Metallographic examination revealed that ductility loss corresponded with the depth of pitting corrosion attack on the exposed and corroded alloys. It is apparent that alloy 3, which has lower iron and manganese contents, is superior in corrosion resistance.

TABLE 4

EFFECT OF MARINE EXPOSURE ON DUCTILITY LOSS

| | Elongation, % in 1 inch | | |
|---|---|---|---|
| Alloy | Before | After | % Loss in Ductility |
| 3 | 23.5 | 19.1 | 19 |
| 7 | 22.5 | 14.5 | 36 |

Improved Formability

Another advantage of our invention is improved formability. Good formability is important to the aircraft manufacturers because of lower costs associated with reduced scrap rates and manpower requirements. Two indicators of formability are (1) ball punch depth as determined by indenting the sheet with a 1-inch diameter steel ball until it cracks (also known as Olsen cup depth), a measure of a material's capability of being stretched in more than one direction, and (2) minimum bend radius, a measure of a material's ability to be bent without cracking. Note that there is some uncertainty in minimum bend radius measurements because the determination of surface cracking is somewhat subjective, and the method involves bending sheet samples around dies of incremental (not continuously varying) radii. Table 5 lists minimum bend radius and depth of alloys 1, 2, 4, 6 and 7. As FIG. 6 illustrates, both of these indicators correlate with % Fe+½% Mn, i.e., alloys with less than about 0.1% Fe and less than about 0.5% Mn have superior formability.

TABLE 5

FORMABILITY OF 2024-T3 SHEET

| Alloy | % Fe | % Mn | Olsen Cup Depth, in. | 180° Min. Bend Radius, in. |
|---|---|---|---|---|
| 1 | 0.035 | 0.33 | 0.336 | 0.025–0.032 |
| 2 | 0.04 | 0.46 | 0.319 | 0.025–0.032 |
| 4 | 0.07 | 0.44 | 0.333 | 0.032–0.064 |
| 6 | 0.16 | 0.77 | 0.287 | 0.080–0.100 |
| 7 | 0.19 | 0.54 | 0.309 | 0.080–0.100 |

Improved Surface Roughness

Three lots each of standard 2024 and the invention composition were chemically milled to half thickness in a buffered 14% NaOH solution. The roughness of the milled surfaces was measured in a direction perpendicular to the rolling direction using a profilometer with a 2 $\mu$m ($2\times10^{-6}$ meters) diamond stylus. The results listed in Table 6 show a 10 to 45% improvement for the invention product.

TABLE 6

SURFACE ROUGHNESS OF CHEMICALLY MILLED SHEET

| Gage, in. | Alloy | Roughness ($\times 10^{-6}$ in.) |
|---|---|---|
| 0.125 | IP[a] | 58 |
| | 2024 | 107 |
| 0.160 | IP | 107 |
| | 2024 | 119 |
| 0.190 | IP | 139 |
| | 2024 | 186 |

[a]Invention Product

Improved Physical Properties by Intermediate Annealing Step

We have also discovered that we can further improve the properties that were discussed above by an intermediate thermal treatment. Specifically, we introduce an intermediate annealing step after hot rolling but before cold rolling to the final gage to produce an improved alloy.

For purposes of the present invention, we prefer a method which includes providing stock comprising an aluminum alloy having about 3.8 to 4.5 wt. % copper, about 1.2 to 1.6 wt. % magnesium, about 0.3 to 0.6 wt. % manganese, not more than 0.15 wt. % silicon, not more than 0.12 wt. % iron, not more than 0.1 wt. % titanium, the remainder substantially aluminum, incidental elements and impurities; hot working the stock; annealing; cold rolling; solution heat treating; and cooling.

Optionally, before the hot working step, we homogenize the stock to produce a substantially uniform distribution of alloying elements. In general, we homogenize by heating the stock to a temperature ranging from about 900 to 975° F. for a period of at least 1.0 hour to dissolve soluble elements and to homogenize the internal structure of the metal. We caution, however, that temperatures above 935° F. are likely to damage the metal and thus we avoid these increased temperatures if possible. Generally, we homogenize for at least 4.0 hours in the homogenization temperature range. Most preferably, we homogenize for about 6.0 to 12.0 hours at about 920° F.

As discussed above, our preferred aluminum alloy comprises about 4.0 to 4.4 wt. % copper, about 1.25 to 1.5 wt. % magnesium, about 0.35 to 0.5 wt. % manganese, not more than 0.12 wt. % silicon, not more than 0.08 wt. % iron, not more than 0.06 wt. % titanium, the remainder substantially aluminum, incidental elements and impurities.

For hot working, we prefer a hot rolling step where the stock is heated to a temperature ranging from about 750 to 925° F. for about 1.0 to 12.0 hours. Most preferably, we heat the stock to a temperature ranging from about 825 to 900° F. for about 1.0 to 2.0 hours to obtain a gage thickness ranging from about 0.1 to 0.25 inches. We generally perform hot rolling at a starting temperature ranging from about 600 to 900° F., or even higher as long as no melting or other ingot damage occurs. When the alloy is to be used for fuselage skins, for example, we typically perform hot rolling on ingot or starting stock 12 to 16 or more inches thick to provide an intermediate product having a thickness ranging from about 0.1 to 0.25 inches.

After hot rolling, we next anneal the stock. Preferably, we anneal at a temperature ranging from about 725 to 875° F. for about 1.0 to 12.0 hours. Most preferably, we anneal the stock at a temperature ranging from about 750 to 850° F. for about 4.0 to 6.0 hours at heating rate ranging from about 25 to 100° F. per hour, with the optimum being about 50° F. per hour.

After annealing, we next cold roll the intermediate gage stock. Preferably, we allow the annealed stock to cool to less than 100° F. and most preferably to room temperature before we begin cold rolling. Preferably, we cold roll to obtain at least a 40% reduction in sheet thickness, most preferably we cold roll to a thickness ranging from about 50 to 70% of the hot rolled gage.

After cold rolling, we next solution heat treat the stock. Preferably, we solution heat treat at a temperature ranging from about 900 to about 940° F. for about 10 to 30 minutes. It is important to rapidly heat the stock, preferably at a heating rate of about 100 to 2000° F. per minute. Most preferably, we solution heat treat at about 920 to 930° F. for about 15 minutes at a heating rate of about 1000° F. per minute.

If the temperature is substantially below 920° F., then the soluble elements, copper and magnesium are not taken into solid solution. This circumstance can be illustrated by reference to FIG. 1. As the temperature is decreased, the lines encompassing the aluminum solid solution region shift to the left as depicted by the arrows. When copper and magnesium are not taken into solution, two undesirable consequences result: (1) there are insufficient alloying elements to provide adequate strength upon subsequent age hardening; and (2) the copper and magnesium-containing intermetallic compounds ($Al_2Cu$ and $Al_2CuMg$) that remain undissolved detract from fracture toughness and fatigue resistance. Similarly, if the time at the solution heat treatment temperature is too short, these intermetallic compounds do not have time to dissolve. The heating rate to the solutionizing temperature is important because relatively fast rates generate a fine grain (crystallite) size, which is desirable for good fracture toughness and high strength.

After solution heat treatment, we rapidly cool the stock to minimize uncontrolled precipitation of secondary phases, such as $Al_2CuMg$ and $Al_2Cu$. Preferably, we quench at a rate of about 1000° F./sec. over the temperature range 750 to 550° from the solution temperature to a temperature of 100° F. or lower. Most preferably, we quench using a high pressure water spray at room temperature or by immersion into a water bath at room temperature, generally ranging from about 60 to 80° F.

EXAMPLE 1

To demonstrate the present invention, we first homogenized two 3"×9" ingots having the composition listed in Table 7 at a temperature of about 910° F. for about 15 hours.

TABLE 7

CHEMICAL COMPOSITIONS OF LABORATORY INGOTS

| | % by wt. | | | | | |
|---|---|---|---|---|---|---|
| Alloy | Si | Fe | Cu | Mn | Mg | Ti |
| A | 0.07 | 0.07 | 3.84 | 0.54 | 1.24 | 0.02 |
| B | 0.07 | 0.09 | 3.83 | 0.98 | 1.22 | 0.02 |

We then reheated the ingots to a temperature of about 800° F. and hot rolled them to an intermediate gage thickness of about 0.200" having a final temperature of about 550° F. We then divided each hot rolled sheet into two sheets. We annealed one of the sheets at a temperature of about 835° F. for about 2.0 hours using heating and cooling rates of about 50° F./hr. The other control sheet was not annealed. Then, we cold rolled all four sheets to a gage of about 0.063" and solution heated treated them at about 920° F. for about 30 minutes. Finally, we quenched all four sheets in room temperature water. We then tested all four sheets after naturally aging them at room temperature for greater than one month (T4 temper) for tensile properties and Kahn tear energy, which are listed in Table 8.

TABLE 8

PROPERTIES WITH AND WITHOUT INTERMEDIATE ANNEAL

| Alloy | Anneal | UTS, ksi | YS, ksi | Elong, % | UPE, in-lb/in$^2$ |
|---|---|---|---|---|---|
| A | Yes | 68.3 | 42.6 | 23.5 | 845 |
| A | No | 66.4 | 40.8 | 24.5 | 755 |
| B | Yes | 68.9 | 42.3 | 22 | 705 |
| B | No | 68.4 | 41.2 | 21 | 650 |

Figure 7:
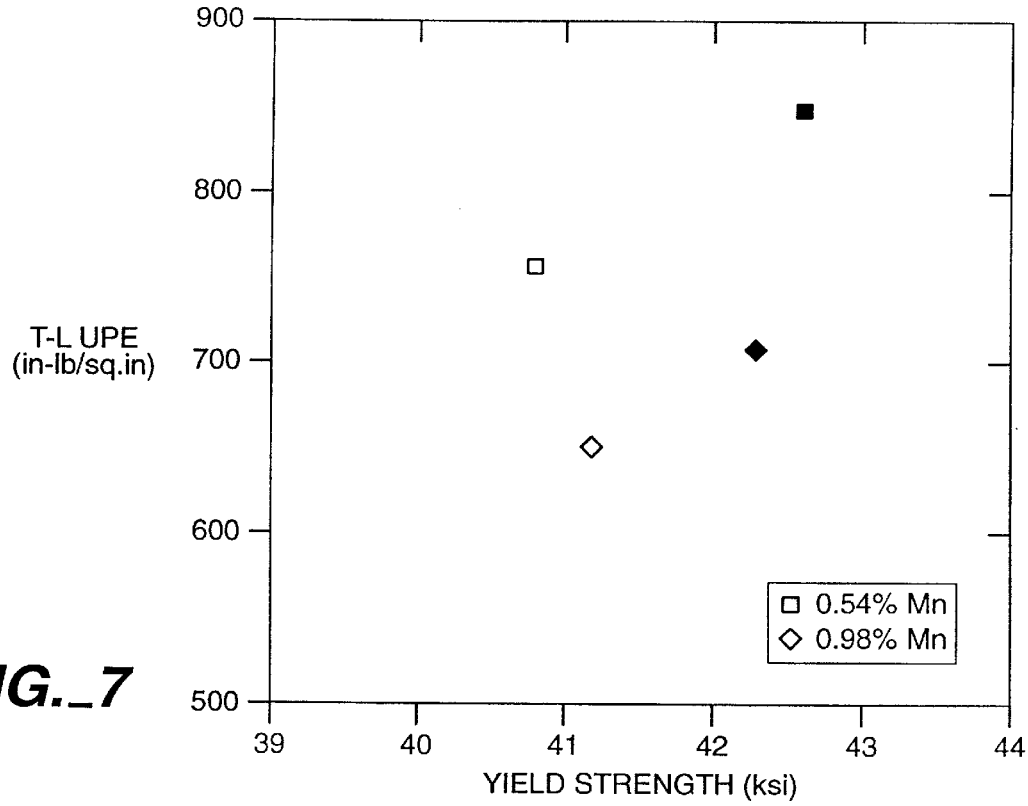
FIG. 7 is a graph showing unit propagation energy of alloys having 0.54 wt. % and 0.98 wt. % Mn fabricated with and without an intermediate anneal.
Figure 10:
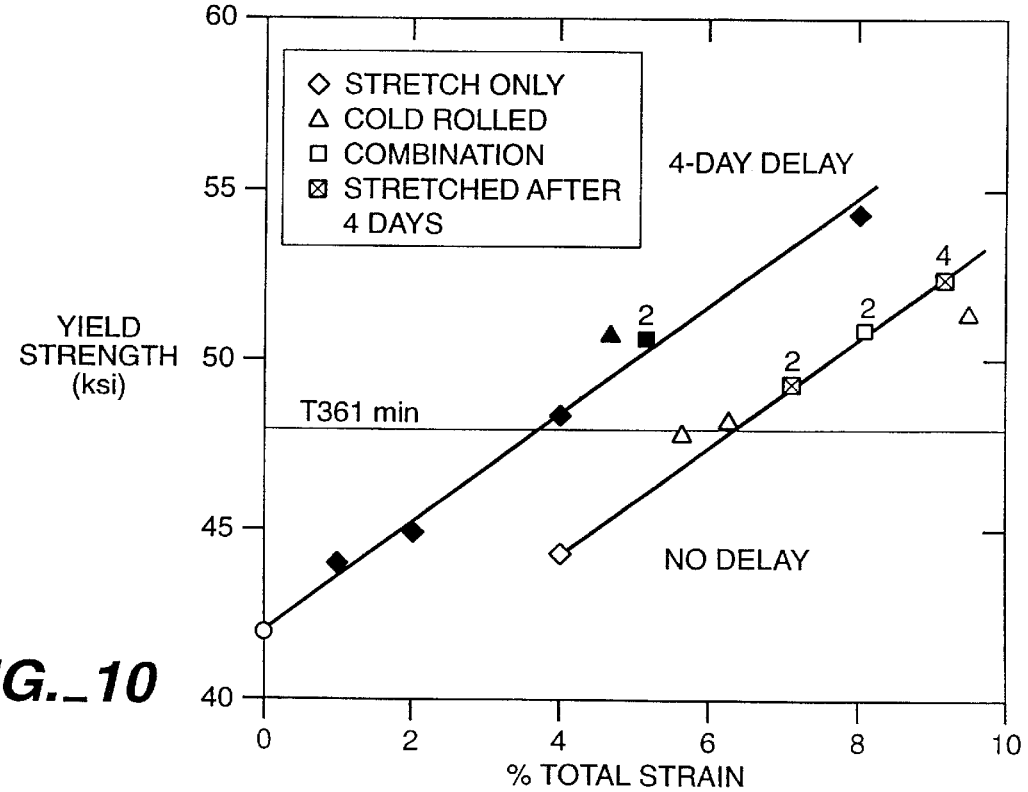
FIG. 10 is a graph showing yield strength as a function of total cold work after solution heat treatment, according to the present invention.

We used the data from Table 8 to plot yield strength versus unit propagation energy in FIG. 7. Surprisingly, the intermediate-annealed variants of both alloys were not only somewhat stronger, they were also significantly tougher than their unannealed counterparts. The lower manganese Alloy A also had higher toughness values than the high manganese Alloy B, as expected based on FIGS. 4 and 5 and our previous discussion, above.

In addition to improvements in mechanical properties, the sheets produced with intermediate annealed had improved formability as evidenced by deeper ball punch depths shown in Table 9.

TABLE 9

BALL PUNCH DEPTHS WITH AND WITHOUT INTERMEDIATE ANNEAL

| Alloy | Anneal | Olsen Cup Depth, in. |
|---|---|---|
| A | Yes | 0.330 |
| A | No | 0.304 |
| B | Yes | 0.295 |
| B | No | 0.265 |

Notably, the lower manganese alloy also had superior forming behavior as would be expected based on my previous discussion.

Figure 8A:
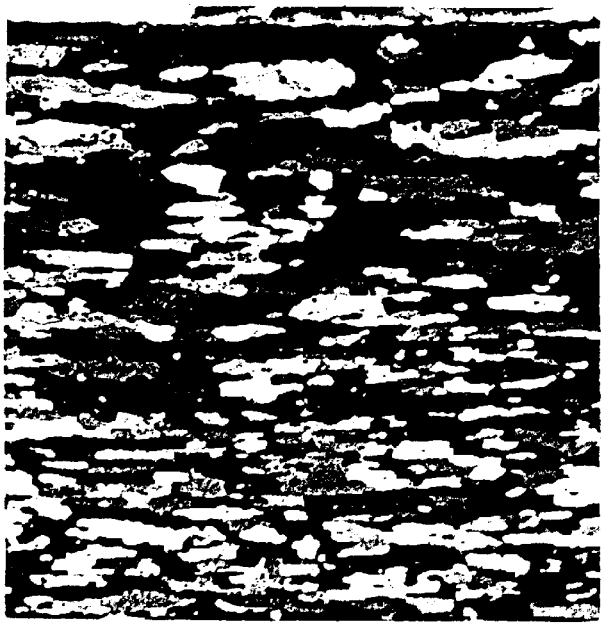
FIG. 8*a* is a photograph showing the improved alloy having 0.54 wt. % Mn without intermediate annealing
Figure 8B:
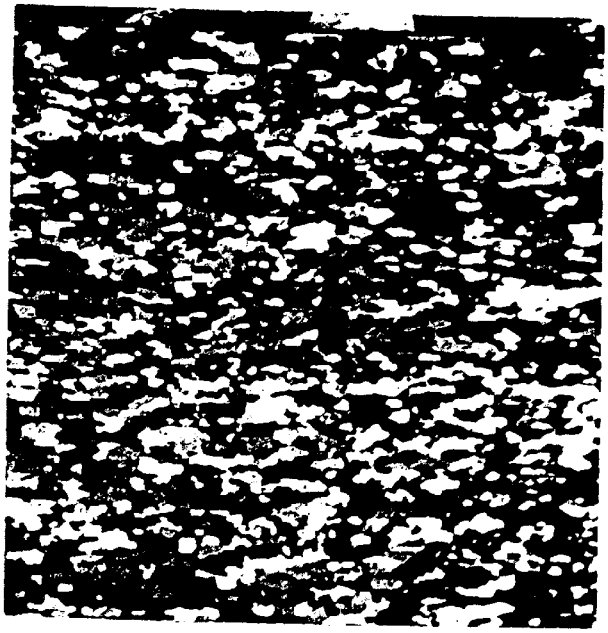
FIG. 8*b* is a photograph of the same alloy with intermediate annealing according to the present invention.
Figure 9A:
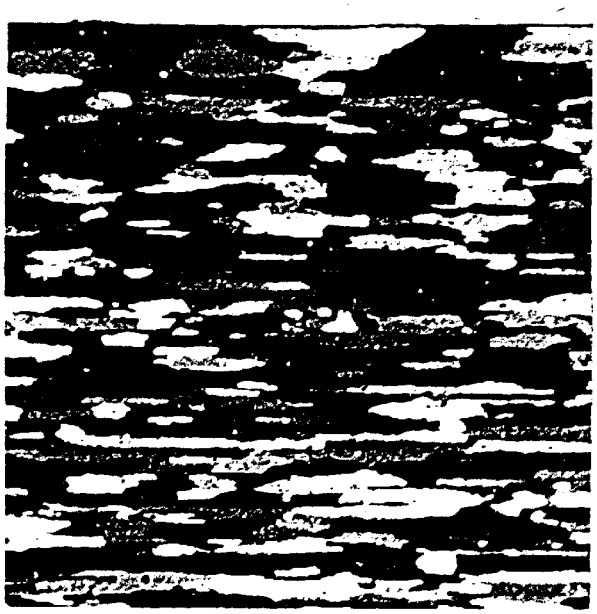
FIG. 9*a* is a photograph showing the improved alloy having 0.98 wt. % Mn without intermediate annealing
Figure 9B:
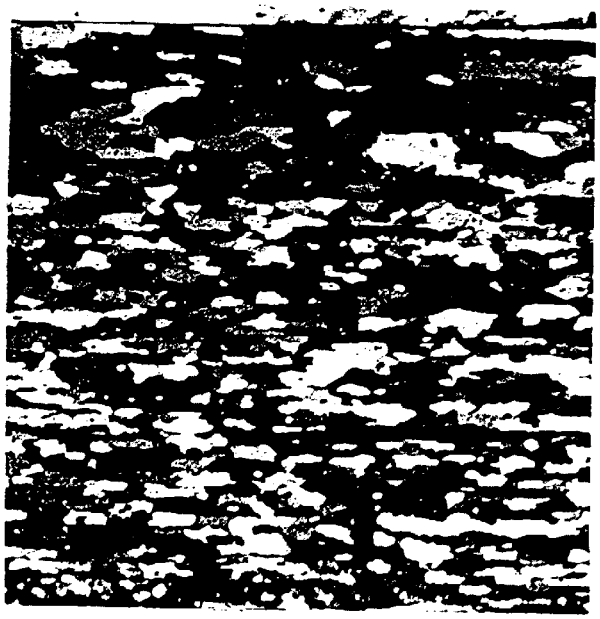
FIG. 9*b* is a photograph of the same alloy with intermediate annealing according to the present invention.
Figure 11:
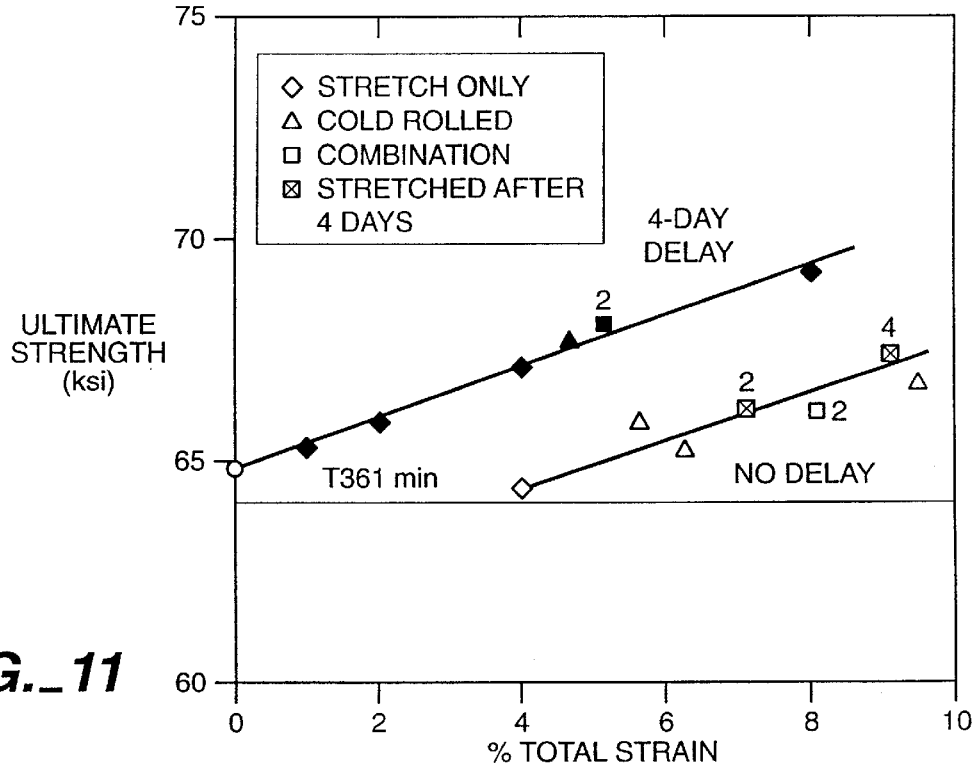
FIG. 11 is a graph showing ultimate strength as a function of total cold work after solution heat treatment, according to the present invention.
Figure 12:
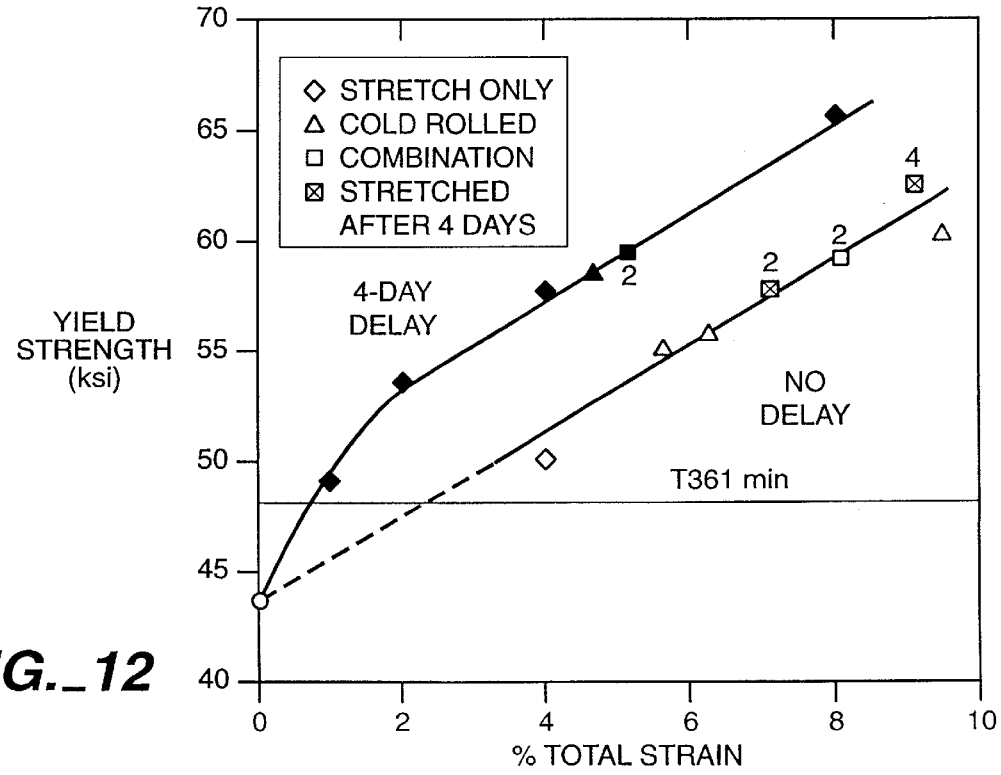
FIG. 12 is a graph showing yield strength as a function of total cold work after solution heat treatment, according to the present invention.
Figure 13:
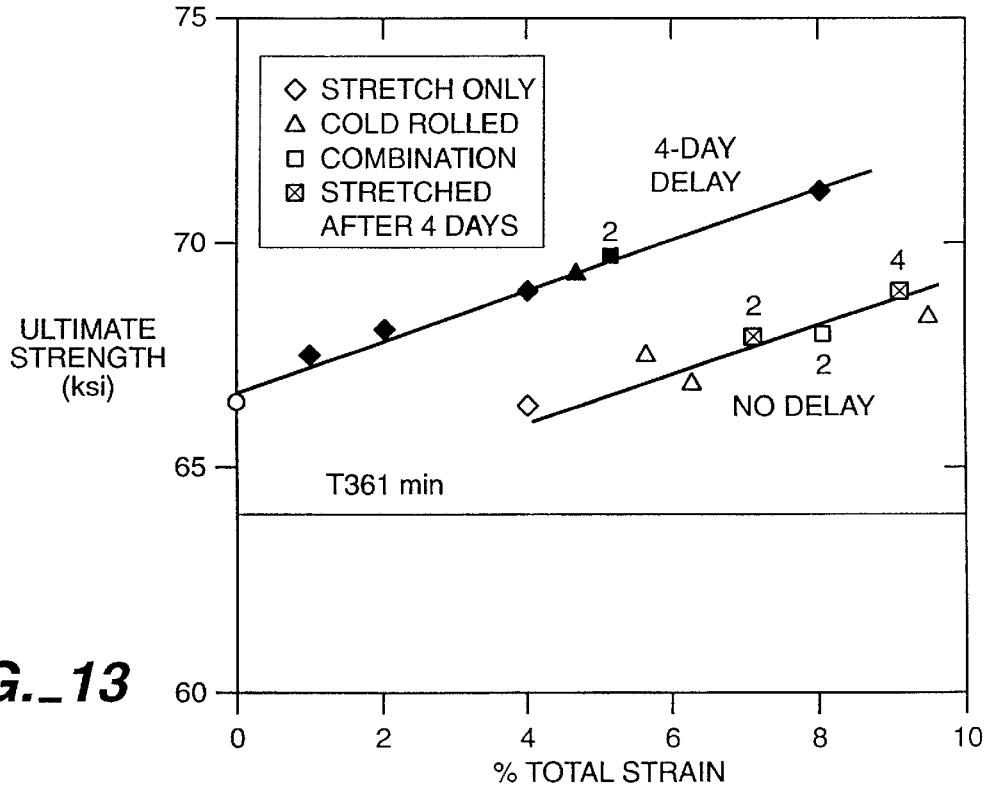
FIG. 13 is a graph showing ultimate strength as a function of total cold work after solution heat treatment, according to the present invention.

In addition, when we examined the grain structures of Alloys A and B, we discovered considerably finer grain sizes in the intermediate-annealed alloys. FIGS. 8*a* and 9*a* compared to FIGS. 8*b* and 9*b*, respectively, illustrate the phenomenon of finer grain size that we observed.

Improved Formability Properties by Selective Cold Working

We have also discovered that we can further improve the properties of our new alloy by selective and careful use of cold working. Conventional 2000 series alloys are often cold worked after solution heat treatment to increase strength. Cold work is, however, detrimental to formability and fracture toughness properties. For a highly desirable combination of strength and formability, we provide the invention alloy and then hot work, intermediate anneal, solution heat treat, quench and minimally cold work the product. In general, the minimal cold work includes a small amount of stretching, leveling, straightening or combinations thereof. Typically, we cold work less than 5% and preferably we use a minimized stretch of 0.5% with minimized or no leveling to achieve T3 property minimums with significantly improved formability.

EXAMPLE 2

To demonstrate the improvement of the new alloy in combination with selective cold working, we prepared several production lots of 2024 alloy sheet. Table 10 illustrates the chemistry of these lots.

TABLE 10

CHEMICAL COMPOSITIONS OF PRODUCTION LOTS OF 2024-T3 SHEETS

| Alloy | % by wt[a] | | | | | | |
|---|---|---|---|---|---|---|---|
| No. | Si | Fe | Cu | Mn | Mg | Ti | Zn |
| 1 | 0.04 | 0.08 | 4.01 | 0.36 | 1.32 | 0.010 | 0.01 |
| 2 | 0.04 | 0.09 | 3.90 | 0.37 | 1.30 | 0.010 | 0.02 |
| 3 | 0.04 | 0.09 | 3.98 | 0.36 | 1.32 | 0.009 | 0.02 |
| 4 | 0.04 | 0.07 | 4.00 | 0.38 | 1.33 | 0.009 | 0.01 |

[a]Measured by Quantometer

In processing these lots to finished sheet, we tightly controlled the amount of cold work. Unconventionally, no stretch was imparted. As we mentioned previously, this is not typical of standard 2000 series product. This sheet product was leveled only, and leveling was strictly controlled to impart only 0.5% to 1% maximum cold work.

Those skilled in the art, will appreciate that minimum bend radius for a given gauge is an excellent measurement of material behavior. This procedure is an accurate representation of break forming of straight flange bends. Break forming and bending is extensively used in aerospace to make production parts. Therefore, this is an area where this invention offers significant manufacturing benefits and opportunities for manufacturing cost improvement. Tables 11A and 11B illustrate the significant improvement of the invention product over conventionally produced 2024-T3. Surprisingly, the data indicate that the invention is essentially equivalent to 2024-O in bending properties.

TABLE 11A

BEND RADIUS (INCHES) OF CONVENTIONAL SHEET

| Thickness (inches) | 2024-T3 | 2024-O |
|---|---|---|
| 0.04 | 0.16 | 0.06 |
| 0.04 | 0.16 | 0.06 |
| 0.04 | 0.16 | 0.06 |
| 0.04 | 0.16 | 0.06 |
| 0.08 | 0.34 | 0.16 |
| 0.08 | 0.34 | 0.16 |
| 0.08 | 0.34 | 0.16 |
| 0.08 | 0.34 | 0.16 |
| 0.10 | 0.44 | 0.22 |
| 0.10 | 0.44 | 0.22 |
| 0.10 | 0.44 | 0.22 |
| 0.10 | 0.44 | 0.22 |
| 0.125 | 0.56 | 0.25 |
| 0.125 | 0.56 | 0.25 |
| 0.125 | 0.56 | 0.25 |
| 0.125 | 0.56 | 0.25 |

TABLE 11B

BEND RADIUS OF INVENTION 2024-T3 SHEET

| Alloy No. | Thk. (inches) | Bend Dir. | Failure | Radius (inches) |
|---|---|---|---|---|
| 1 | 0.04 | L | No | 0.06 |
| 1 | 0.04 | L | No | 0.06 |
| 1 | 0.04 | T | No | 0.06 |
| 1 | 0.04 | T | No | 0.06 |
| 2 | 0.08 | L | No | 0.16 |
| 2 | 0.08 | L | No | 0.16 |
| 2 | 0.08 | T | No | 0.16 |
| 2 | 0.08 | T | No | 0.16 |
| 3 | 0.1 | L | No | 0.16 |
| 3 | 0.1 | L | No | 0.16 |
| 3 | 0.1 | T | No | 0.16 |
| 3 | 0.1 | T | No | 0.16 |
| 4 | 0.125 | L | No | 0.19 |
| 4 | 0.125 | L | No | 0.19 |
| 4 | 0.125 | T | Yes | 0.19 |
| 4 | 0.125 | T | Yes | 0.19 |

As discussed earlier, in addition to formability properties, we must also consider the other mechanical properties of the product. Table 12 illustrates the success of this invention in realizing acceptable properties. Importantly, the ultimate strength, yield strength, and elongation properties are well above aerospace established specification requirements for 2024-T3. Also, with respect to a 100 lot production average of conventional 2024-T3, the data reveal acceptable correlation with ultimate strength and yield strength, and superior elongation.

TABLE 12

TRANSVERSE PROPERTIES OF PRODUCTION LOTS OF BARE 2024-T3 SHEET WITH CONTROLLED COLD WORK IMPARTED BY LEVELING

| Alloy No. (Gauge) | UTS, ksi | YS, ksi | Elong, % |
|---|---|---|---|
| 1 (0.040") | 67.8 | 46.3 | 21.5 |
| 1 (0.040") | 67.8 | 46.3 | 21.0 |
| 2 (0.080") | 66.0 | 44.8 | 23.9 |
| 2 (0.080") | 66.2 | 45.4 | 23.3 |
| 3 (0.100") | 65.1 | 43.3 | 24.4 |
| 3 (0.100") | 65.6 | 43.3 | 23.7 |
| 4 (0.125") | 66.9 | 44.7 | 23.9 |
| 4 (0.125") | 66.9 | 44.7 | 24.1 |
| 2024-T3 Minimum Specification Requirement (0.010"–0.128") | 63.0 | 42.0 | 15 |
| Average 2024-T3 Values (100 Lots) | 68.3 | 46.9 | 18.5 |

Improved Combination of Strength and Toughness by Selective Cold Working

In addition, we have discovered that by employing a holding step prior to cold working, we can further enhance the strength and toughness properties of the invention alloy. This is important because aircraft manufacturers have an interest in fuselage sheet and light gage plate products with higher strengths than 2024-T3. Although 2024-T361 has higher strength than 2024-T3, it has not been considered for many applications because its toughness is lower than that of 2024-T3.

Thus, in an alternative embodiment of the invention, we describe a method for producing a T36 temper product which has an improved combination of strength and toughness. In general, we use our preferred chemistry, hot work, anneal, solution heat treat and quench steps. Next, we hold the sheet until it reaches a stable condition. As used herein, we define "stable condition" to be such that the product has achieved 95% of its inherent strength level, thereby experiencing little further increase in strength with increasing natural aging time at room temperature. Typically, we hold the product for at least 12 hours but generally not longer than two weeks. After we achieve a stable condition, we then cold work the sheet to impart a T36 temper. This embodiment of our invention is illustrated in Example 3.

EXAMPLE 3

We sheared fourteen 8" wide by 24" long panels from a 0.063" production lot of Alclad sheet having the composition within the preferred range of the invention chemistry as set forth in Table 13:

TABLE 13

CHEMICAL COMPOSITION OF SPECIAL CHEMISTRY 2024 SHEET % by wt.[a]

| Si | Fe | Cu | Mn | Mg | Zn | Ti |
|---|---|---|---|---|---|---|
| 0.05 | 0.07 | 4.05 | 0.45 | 1.27 | 0.23 | 0.05 |

[a]Through-thickness composition of core alloy by ICP analysis except for Si (Quantometer melt analysis).

We solution heat treated the panels at 920° F. for 15 min. and quenched them in room temperature water. Table 13 sets forth the various cold roll/stretch combinations that we applied—note that some sheets were cold worked immediately (<1 hr.) after quenching; others were strained after a 4-day delay.

TABLE 14

COLD WORK SCHEDULE APPLIED TO SPECIAL CHEMISTRY 2024 SHEET

| Delay | % Cold Roll | % Stretch | Total Strain, % |
|---|---|---|---|
| — | 0 | 0 | 0 |
| 0 | 0 | 4 | 4.0 |
| 0 | 6.1 | 2 | 8.1 |
| 0 | 5.3 | 1* | 6.3 |
| 0 | 4.7 | 1* | 5.7 |
| 0 | 8.5 | 1* | 9.5 |
| 0 | 5.1 | 2* | 7.1 |
| 0 | 5.1 | 4* | 9.1 |
| 4d | 0 | 1 | 1.0 |
| 4d | 0 | 2 | 2.0 |
| 4d | 0 | 4 | 4.0 |
| 4d | 0 | 8 | 8.0 |
| 4d | 3.2 | 2 | 5.2 |
| 4d | 3.7 | 1 | 4.7 |

*Delay between cold rolling and stretching was 4 days.

After about to weeks of natural aging, we tested the panels for longitudinal and transverse tensile properties and T-L Kahn tear properties (toughness indicators). We samples for T-L fatigue crack growth rate at a stress ratio of 0.1.

The yield and tensile strengths are plotted against % strain in FIGS. 10 through 13. The data separate into two trend lines: one for the 4-day delay between solution heat treating and cold work; the other for no delay. The 4-day delay gave substantially higher strengths for a given level of cold work, requiring about 4% strain to achieve the 48 ksi minimum T361 yield strength. Without a delay, achieving the minimum yield strength required about 7% cold work. The minimum transverse ultimate strength was easier to meet (FIG. 11): 0% cold work with no delay, 4% with a delay. Notably, when a 2–4% stretch superseded immediate cold rolling, the strengths fell on the "No-Delay" curve, even if there was a 4-day delay between the two operations. This shows that immediate cold work must be minimized.

Figure 14:
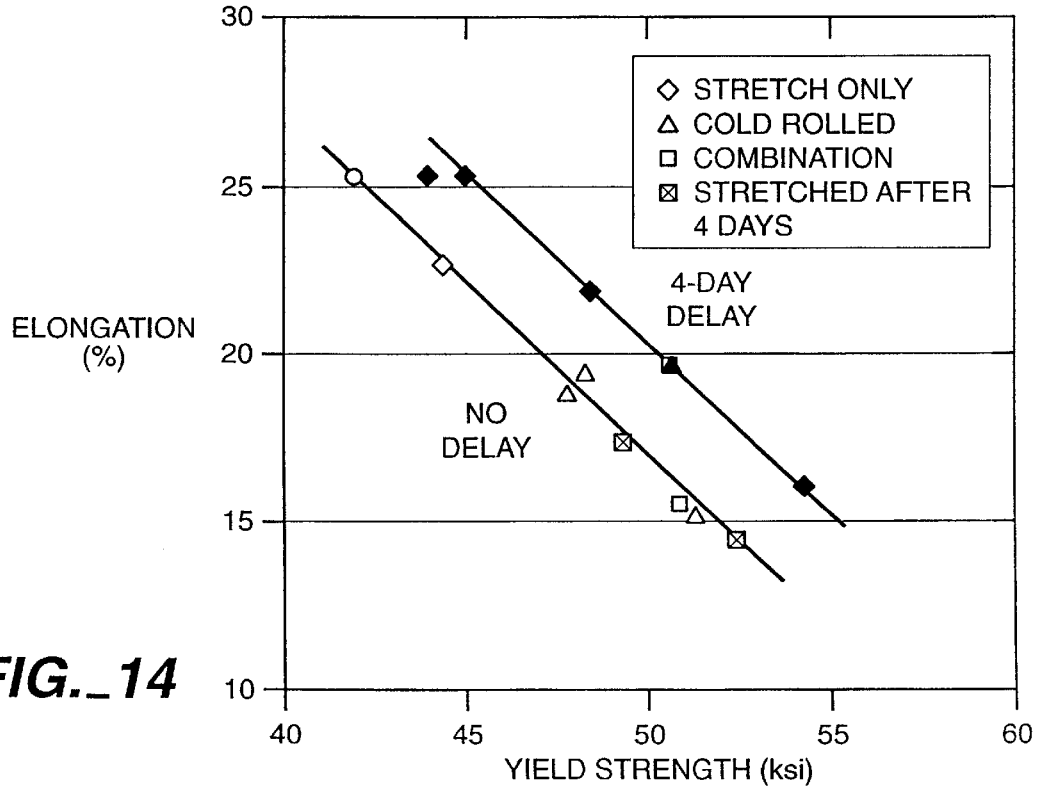
FIG. 14 is a graph showing elongation as a function of yield strength, according to the present invention.

FIG. 14, a correlation plot between transverse elongation and strength, shows that a better combination of properties was achieved with the 4-day delay. All the elongation data were comfortably above the 9% minimum for 2024-T361.

Figure 15:
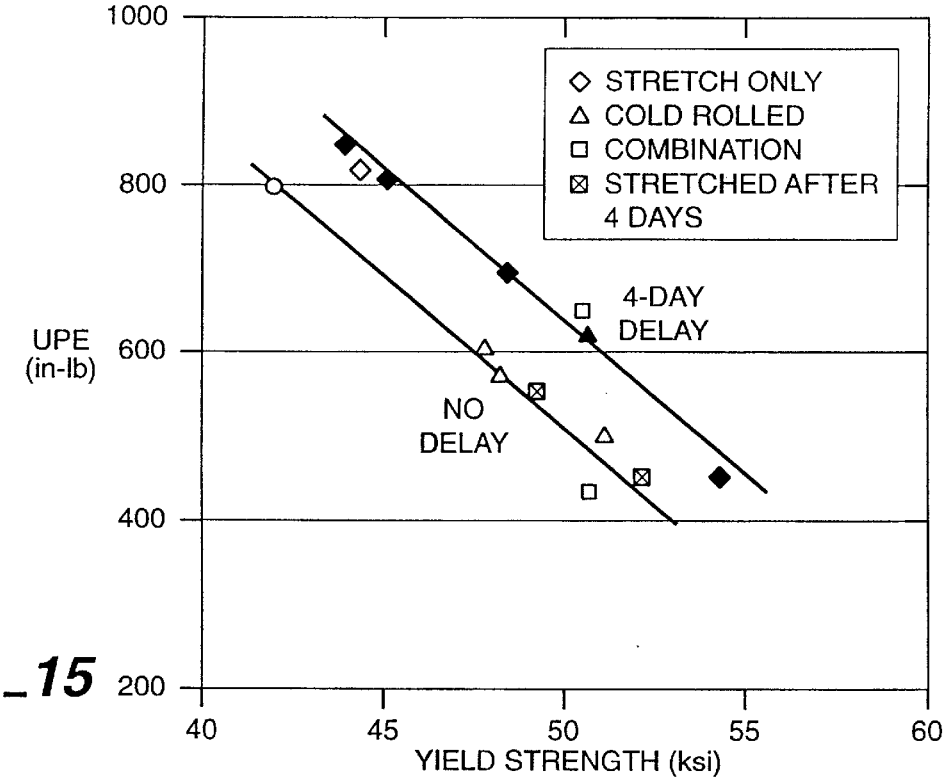
FIG. 15 is a graph showing toughness as a function of yield strength, according to the present invention.

The Kahn tear unit propagation energies (UPE) are plotted against transverse yield strength in FIG. 15. As with elongation, a better combination of UPE and strength was achieved with the 4-day delay. According to FIG. 15, sheet with a yield strength of 51–53 ksi, should have a UPE of about 500 in.-lb./in.$^2$, approximately the same as conventional 2024-T3 with a yield strength of only about 45 ksi. Of course, depending on the aircraft design requirements, the combination of strength and toughness values can be adjusted by varying the amount of cold work.

Figure 16:
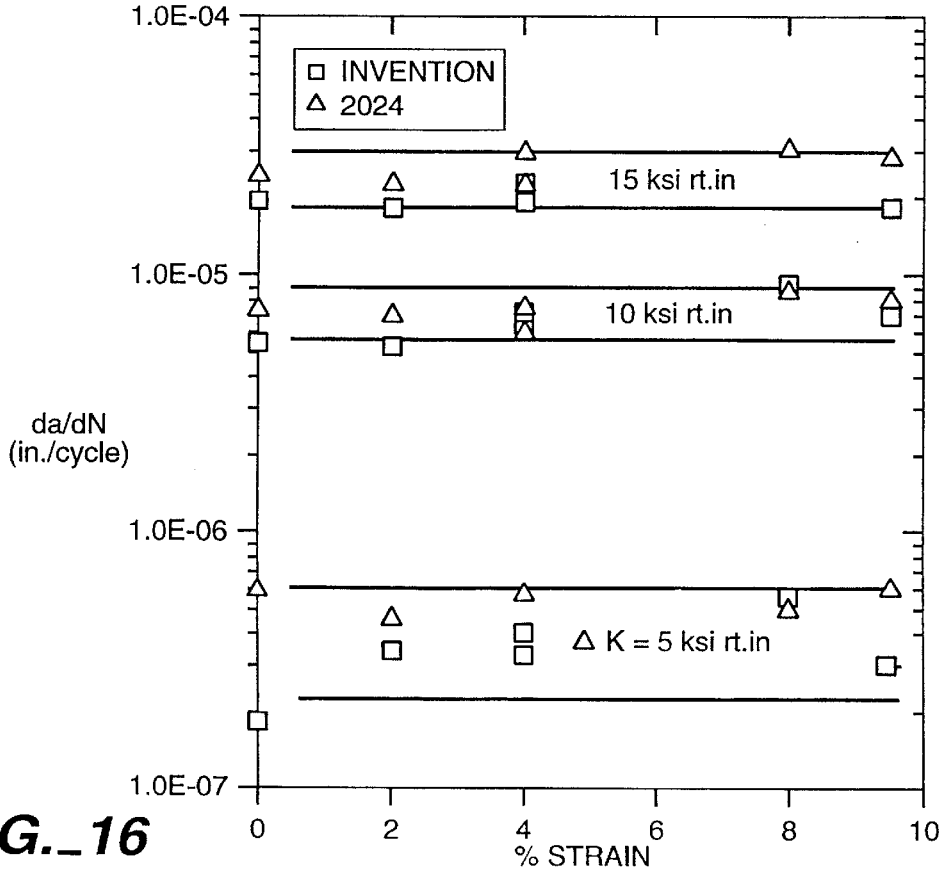
FIG. 16 is a graph showing fatigue crack growth rate as a function of cold work after solution heat treatment, according to the present invention.
Figure 17:
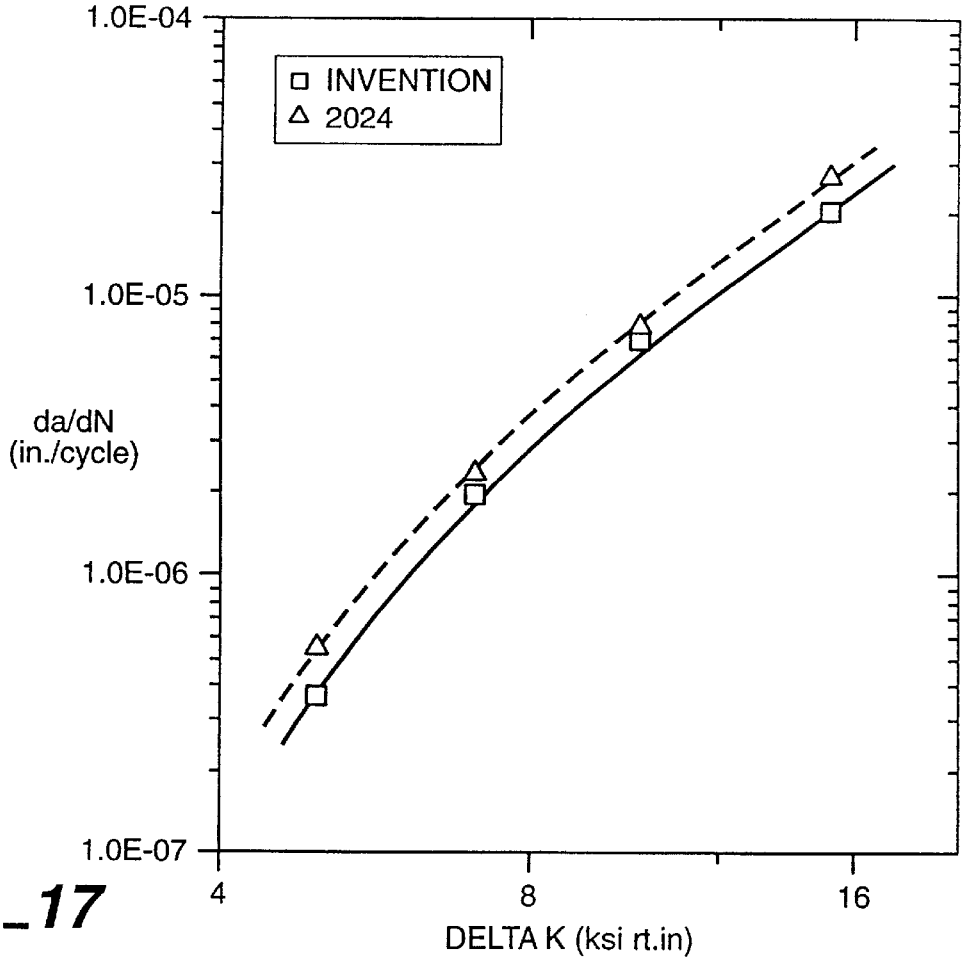
FIG. 17 is a graph showing a comparison of an alloy according to the present invention to a conventional AA 2024 alloy regarding fatigue crack growth rate as a function of Delta K.

Six samples representing delay times of 0 and 4 days with 0 to 9.5% strain were tested for fatigue crack growth rate (FCGR) together with six conventional 2024 sheet samples given identical mechanical treatments. FIG. 16, a combination of the data for the two materials, shows that FCGR is independent of cold work over the $\Delta K$ range of 5 to 15 ksi $\sqrt{in}$. The averaged da/dN data for each material are compared in FIG. 17, which shows lower crack growth rates for the invention composition by an average of about 10–35%.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

We claim:

1. A method of producing an aluminum product comprising:

(a) providing a stock comprising an aluminum alloy comprising about 3.8 to 4.9 wt. % copper, about 1.2 to 1.8 wt. % magnesium, about 0.3 to 0.9 wt. % manganese, not more than 0.30 wt. % silicon, not more than 0.30 wt. % iron, not more than 0.15 wt. % titanium, the remainder being substantially aluminum, incidental elements and impurities;

(b) hot working the stock;

(c) heating the hot worked stock to a temperature between 725° F. and 875° F. to anneal the alloy;

(d) solution heat treating the stock;

(e) cooling the stock;

(f) minimal cold working the stock to produce an improved alloy having increased formability.

2. The method of claim 1 wherein the cold working is selected from the group consisting of stretching, straightening, leveling and combinations thereof.

3. The method of claim 2 wherein the cold work comprises less than 2.0% stretching.

4. The method of claim 1 wherein the alloy of step (a) comprises about 4.0 to 4.4 wt. % copper, about 1.25 to 1.5 wt. % magnesium, about 0.35 to 0.5 wt. % manganese, not more than 0.12 wt. % silicon, not more than 0.08 wt. % iron, not more than 0.06 wt. % titanium, the remainder substantially aluminum, incidental elements and impurities.

5. The method of claim 1 wherein step (b) comprises hot rolling the stock at a temperature ranging from about 750 to 925° F. for about 1 to 12 hours to obtain a gage thickness ranging from about 0.1 to 0.25 inches.

6. The method of claim 1 wherein step (c) comprises annealing at a temperature ranging from about 725 to 875° F. for about 1 to 12 hours.

7. The method of claim 1 wherein step (d) comprises solution heat treating at a temperature ranging from about 900 to 940° F. for about 10 to 30 minutes.

8. The method of claim 1 wherein step (e) comprises cooling by quenching.

9. The method of claim 1 further comprising cold rolling after step (c) annealing.

10. A method in accordance with claim 1, step (f) wherein the stock is cold worked less than 5%.

11. A method of producing an aluminum product comprising:

(a) providing a stock comprising an aluminum alloy comprising about 3.8 to 4.9 wt. % copper, about 1.2 to 1.8 wt. % magnesium, about 0.3 to 0.9 wt. % manganese, not more than 0.30 wt. % silicon, not more than 0.30 wt. % iron, not more than 0.15 wt. % titanium, the remainder being substantially aluminum, incidental elements and impurities;

(b) hot working the stock;

(c) heating the hot worked stock to a temperature between 725° F. and 875° F. to anneal the alloy;

(d) solution heat treating the stock;

(e) cooling the stock;

(f) holding the stock to obtain a stable condition; and (g) cold working the stock to produce an improved alloy having increased strength and toughness properties.

12. The method of claim 11 wherein step (f) comprises holding for at least 12 hours at room temperature.

13. The method of claim 11 wherein the cold working is selected from the group consisting of stretching, straightening, leveling and combinations thereof.

14. The method of claim 11 wherein the amount of cold work is sufficient to impart a T36 temper.

15. The method of claim 11 wherein the amount of cold work ranges from about 4% to 7%.

16. The method of claim 11 wherein the alloy of step (a) comprises about 4.0 to 4.4 wt. % copper, about 1.25 to 1.5 wt. % magnesium, about 0.35 to 0.5 wt. % manganese, not more than 0.12 wt. % silicon, not more than 0.08 wt. % iron, not more than 0.06 wt. % titanium, the remainder substantially aluminum, incidental elements and impurities.

17. The method of claim 11 wherein step (b) comprises hot rolling the stock at a temperature ranging from about 750 to 925° F. for about 1 to 12 hours to obtain a gage thickness ranging from about 0.1 to 0.25 inches.

18. The method of claim 11 wherein step (c) comprises annealing at a temperature ranging from about 725 to 875° F. for about 1 to 12 hours.

19. The method of claim 11 wherein step (d) comprises solution heat treating at a temperature ranging from about 900 to 940° F. for about 10 to 30 minutes.

20. A method in accordance with claim 11, step (g) wherein the stock is cold worked less than 5%.

21. A method of producing an aluminum product comprising:

(a) providing a stock comprising an aluminum alloy comprising about 3.8 to 4.9 wt. % copper, about 1.2 to 1.8 wt. % magnesium, about 0.3 to 0.9 wt. % manganese, not more than 0.30 wt. % silicon, not more than 0.30 wt. % iron, not more than 0.15 wt. % titanium, the remainder being substantially aluminum, incidental elements and impurities;

(b) hot working the stock;

(c) heating the hot worked stock to a temperature between 725° F. and 875° F. to anneal the alloy;

(d) solution heat treating the stock;

(e) cooling the stock;

(f) holding the stock for at least 12 hours; and (g) cold working the stock from about 4% to 7% to produce an improved alloy having increased strength and toughness properties.

22. A product produced by the method of claim 1.

23. A product produced by the method of claim 11.

24. A product produced by the method of claim 21.

* * * * *